US009839330B2

(12) United States Patent
Aykens et al.

(10) Patent No.: US 9,839,330 B2
(45) Date of Patent: Dec. 12, 2017

(54) SHOWER TRACK GUIDE SYSTEM

(71) Applicant: Kohler Co., Kohler, WI (US)

(72) Inventors: Steven R. Aykens, Sheboygan Falls, WI (US); Mark A. Johnson, Plymouth, WI (US); James L. Marlowe, Troy, TN (US); Roque M. Corpuz, Jr., Sheboygan, WI (US); Nicholas Pairolero, Sheboygan, WI (US); Michael R. Bates, Rogers, MN (US)

(73) Assignee: KOHLER CO., Kohler, WI (US)

( * ) Notice: Subject to any disclaimer, the term of this patent is extended or adjusted under 35 U.S.C. 154(b) by 100 days.

(21) Appl. No.: 14/207,125

(22) Filed: Mar. 12, 2014

(65) Prior Publication Data

US 2014/0259364 A1 Sep. 18, 2014

Related U.S. Application Data

(60) Provisional application No. 61/793,476, filed on Mar. 15, 2013.

(51) Int. Cl.
*A47K 3/34* (2006.01)

(52) U.S. Cl.
CPC ..... *A47K 3/34* (2013.01)

(58) Field of Classification Search
CPC . A47K 3/34; E05Y 2900/114; E05D 15/0656; E05D 15/0652; E05D 15/0686
See application file for complete search history.

(56) References Cited

U.S. PATENT DOCUMENTS

| | | | | | |
|---|---|---|---|---|---|
| 2,374,490 | A | * | 4/1945 | Lehman | A47K 3/34 4/557 |
| 2,893,069 | A | * | 7/1959 | Kessler | A47K 3/34 16/94 R |
| 2,911,654 | A | | 11/1959 | Bruno | |
| 3,018,523 | A | | 1/1962 | Wilson | |
| 3,783,456 | A | | 1/1974 | Doan | |
| 3,896,508 | A | | 7/1975 | Doan | |
| 4,125,141 | A | | 11/1978 | Stillwell | |
| 4,445,239 | A | | 5/1984 | Jacobsen | |
| 4,785,485 | A | * | 11/1988 | Etesam | A47K 3/34 4/557 |
| 5,575,022 | A | * | 11/1996 | Duffy | A47K 3/34 4/557 |

(Continued)

FOREIGN PATENT DOCUMENTS

| | | |
|---|---|---|
| CH | 506668 | 4/1971 |
| CN | 1219114 A | 6/1999 |

(Continued)

OTHER PUBLICATIONS

European Search Report and Written Opinion dated Jul. 2, 2014; 8 pgs.

*Primary Examiner* — Janie Loeppke
(74) *Attorney, Agent, or Firm* — Foley & Lardner LLP

(57) ABSTRACT

A shower track guide system for a shower enclosure may include an elevated track positioned above a base and at least one stand disposed between the base and the track. The track may be mounted to the at least one stand. A shower door may be movable along a top of the track to permit access to the shower enclosure. The stand may elevate the track above the base to permit water to flow underneath the track.

18 Claims, 2 Drawing Sheets

(56) References Cited

U.S. PATENT DOCUMENTS

| | | | | |
|---|---|---|---|---|
| 5,848,446 | A * | 12/1998 | DeBraal | A47K 3/34 4/557 |
| 6,435,254 | B1 | 8/2002 | Todd | |
| 2002/0092628 | A1* | 7/2002 | Todd | A47K 3/38 160/309 |
| 2004/0003556 | A1* | 1/2004 | Zerbst | E04B 2/7422 52/220.7 |
| 2007/0234512 | A1 | 10/2007 | Cervantes | |
| 2008/0078068 | A1 | 4/2008 | Cervantes | |
| 2013/0097935 | A1* | 4/2013 | Sprague | E05D 15/0686 49/425 |
| 2014/0068853 | A1* | 3/2014 | Opwald | A47K 3/362 4/607 |

FOREIGN PATENT DOCUMENTS

| | | |
|---|---|---|
| CN | 201079329 | 7/2008 |
| CN | 202266138 | 6/2012 |
| CN | 202288043 U | 7/2012 |
| CN | 202767713 U | 3/2013 |
| EP | 0985793 | 3/2000 |

* cited by examiner

SHOWER TRACK GUIDE SYSTEM

CROSS-REFERENCE TO RELATED PATENT APPLICATIONS

This application claims priority to and the benefit of U.S. Provisional Patent Application No. 61/793,476, filed Mar. 15, 2013, the entire disclosure of which is incorporated herein by reference.

BACKGROUND

The present application relates generally to the field of shower doors. More specifically, the present application relates to an elevated track for a shower door with a guide to control movement of the shower door.

Shower doors serve to prevent water damage and form a barrier to contain a shower area within a bathroom. The contained shower area prevents water from spraying out or discharging into the remainder of the bathroom. The contained shower area further prevents water from accumulating on the floors of the bathroom.

In some showers, shower doors are positioned in track systems to control movement of the shower doors. Such shower track systems are generally used in assemblies including multiple doors.

The track systems of some showers permit water to accumulate, leading to stagnant water and bacteria. Additionally, dirt and debris may accumulate in the tracks of the track systems. Further, such track systems may not be aesthetically pleasing to a user.

A need exists for improved technology, including technology that provides an aesthetically pleasing track system to guide shower doors while permitting water to flow freely underneath the tracks.

SUMMARY

An exemplary embodiment relates to a shower track guide system for a shower enclosure that may include an elevated track positioned above a base and at least one stand disposed between the base and the track. The track may be mounted to the at least one stand. A shower door may be movable along a top of the track to permit access to the shower enclosure. The stand may elevate the track above the base to permit water to flow underneath the track.

Another exemplary embodiment relates to a shower guide track system for a bypass shower door system which may include at least one shower door. The shower guide track system may further include a track along which the shower door may be movable, wherein the track may be elevated above a base, and at least one guide may be coupled to the shower door. The at least one guide may be configured to move along a top of the track. A clearance between the track and the base may be maintained by at least one stand coupled to the track.

Another exemplary embodiment relates to a shower enclosure which may include an elevated track positioned above a base, a shower door movable along a top of the track, and at least one stand coupled to the track, which may be configured to provide a clearance between the track and the base.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Conventional shower door guides often use grooved tracks for a shower door to sit in and slide, thus partitioning a shower area from a remainder of a bathroom. Such a partition is desirable for helping to contain moisture and warm air within the shower area. However, conventional guides may allow water and dirt to accumulate within the grooves of the tracks.

Generally, a shower door can include a frame for a pane of plastic or glass. A shower door frame can be attached to slide to a fixed track that is disposed beneath a lower portion of the door, closest to the floor. In some showers, another track may be disposed atop an upper portion of the door, closest to a ceiling. Shower doors can slide or ride along the tracks to permit ingress to and egress from the shower. Some shower track systems are used in assemblies that include multiple doors positioned at different distances from a showerhead. In such systems, each door can pass another because each door slides on a separate track, as in a bypass shower door system.

If a user sought to clean the shower doors, it may be desirable for the shower track system not to include tracks with deep recesses that form nooks and crannies in which shower doors are positioned.

Figure 1:
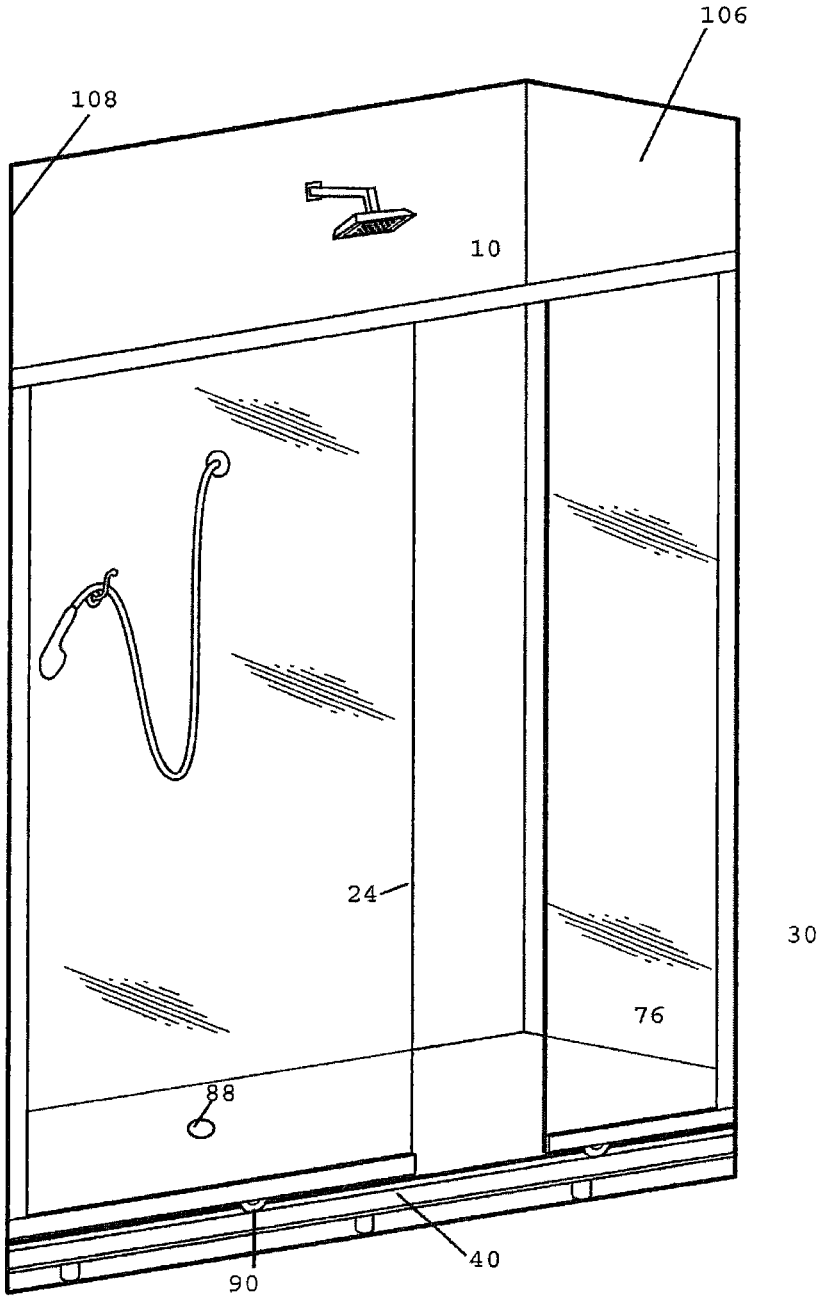
FIG. 1 is a cutaway view of a shower enclosure including a shower track guide system.

Referring now to FIG. 1, a shower enclosure 10 according to an embodiment of a shower guide track system is shown. The shower enclosure 10 may be provided, for example, in a bathroom and includes shower doors that form a barrier between the shower enclosure 10 and a remainder of the bathroom 30. An inner shower door 24 is connected to rollers 90 that are attached on an underside of door 24. The rollers 90 are configured to ride on a track 40 in a direction of door movement, permitting the door 24 to slide to permit access to the shower enclosure 10 or to the remainder of the bathroom 30. In some embodiments, mounts are provided in lieu of rollers 90, and such mounts can screw to a pane of inner door 24 or be fastened using adhesive materials, for example. An outer door 76 is disposed in front of the inner door 24.

Figure 2:
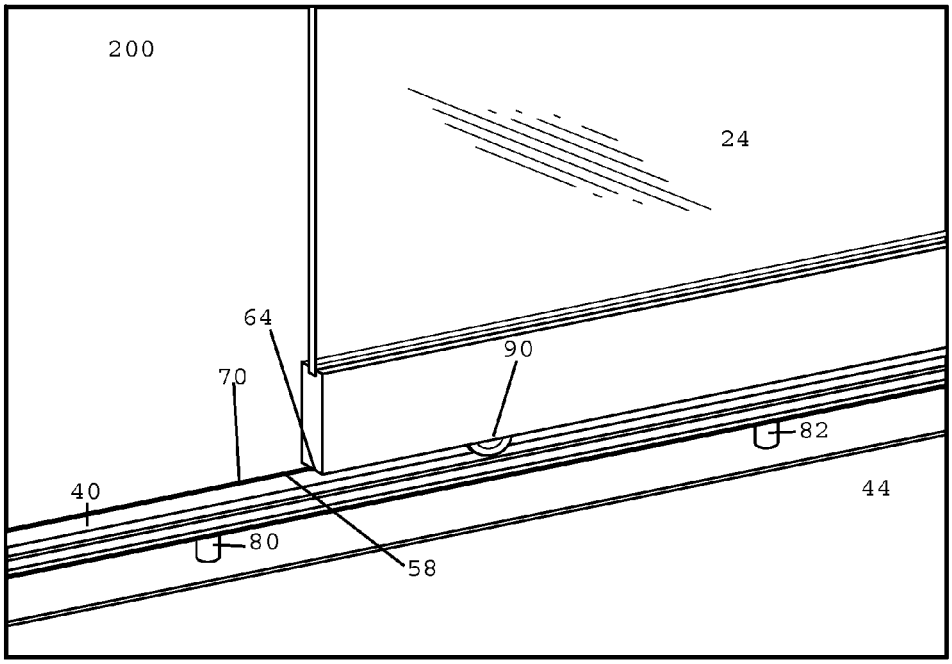
FIG. 2 is a perspective view of a portion of a shower track guide system according to an exemplary embodiment.

Referring to FIG. 2, an exemplary embodiment of a shower track guide system is shown. A shower track guide system 200 of FIG. 2 includes the elevated track 40 that is positioned above the floor 44 (or above another surface of the shower or track system). The shower track guide system 200 further includes the inner shower door 24 that is configured to ride along the elevated track 40. Additionally, the shower track guide system 200 includes stands 80 and 82 on which the track 40 sits that provide a clearance corresponding to the height of the elevated track 40 above the floor or other surface.

As shown in FIG. 2, the exemplary embodiment of the shower track guide system 200 includes at least one roller 90 that is a guide for controlling movement of the door 24. In some embodiments, the roller 90 is a wheel to which the door 24 is connected. In some embodiments, the guide is not a roller such as the roller 90, but instead has an inverted U-shape or another shape (see, e.g., the embodiment shown in FIG. 3). The roller 90 is disposed above the elevated track 40 such that the roller 90 can roll or slide along the top 70 of the elevated track 40. In some embodiments, a pair of rollers 90 are connected to each shower door 24. A riding movement of the door 24 thus occurs in conjunction with riding movement of the roller 90. The riding movement may include sliding and gliding movements in addition to rolling actions. A connection between the roller 90 and the door 24 can be accomplished in various manners, such as using a mounting element (not shown) that attaches to both of the roller 90 and the door 24. The mounting element couples the shower door 24 to the roller 90. The mounting element can include screws, for example. In some embodiments, the mounting element includes a screw sheathed with a rubber bumper.

In some embodiments, portions of the roller 90 may have widths that exceed with width 58 of the elevated track 40. For example, a diameter of the roller 90 may exceed the width 58. In some embodiments, the roller 90 is formed of hard plastic. In other embodiments, the roller 90 includes both plastic and metallic materials. In some embodiments, the roller 90 may be made out of these and other various materials, including polymeric materials, composite materials, and any combination of such materials. In some embodiments, the roller 90 is a bearing that supports a load of the shower door. The bearing, for example, can include a concentric or eccentric wheel bushing in some embodiments. In some embodiments, the bearing can be permanently sealed and lubricated. In some embodiments, the bearing may include a rubber seal. Further, some embodiments include a bearing that is stainless steel.

Figure 3:
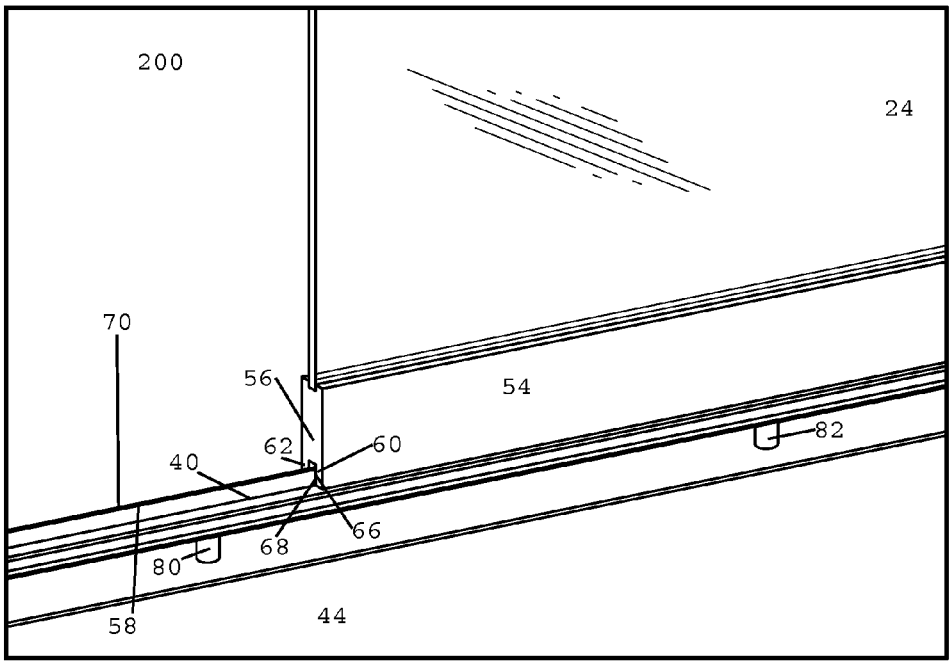
FIG. 3 is a perspective view of a portion of a shower track guide system according to another embodiment.

Referring to FIG. 3, another embodiment of a shower track guide system is shown. The shower track guide system of FIG. 3 includes an elevated track 40 that is positioned at a given height from a floor 44, where the height is dictated by the height of stands 80 and 82. The elevated track 40 is configured so that a shower door 24 can slide along the track easily. Each shower door 24 is fixed to an attachment 54 to permit movement of the door 24 along the track 40. The attachment 54 can be formed in an inverted U-shape, for example. In the exemplary embodiment shown in FIG. 3, the inverted U-shape of the attachment 54 includes a body portion 56 and two stem portions 60 and 62 on opposing sides of the body portion 56. The two stem portions 60 and 62 are side portions that are longer than the body portion 56. Each of stem portions 60 and 62 is rectilinear and extends downward towards the floor 44. The body portion 56 is disposed horizontally to parallel a width 58 of the elevated track 40 that is a transverse section.

A width 64 of the body portion 56 exceeds the width 58 of the elevated track 40 such that ends of the body portion 56 project outward beyond the elevated track 40. In some embodiments, the two stem portions 60 and 62 are not longer than the body portion 56. In some embodiments, the stem portions 60 and 62 are not rectilinear or symmetric. In some embodiments, the body portion 56 and stem portions 60 and 62 are formed as a single plastic injection-molded part. In other embodiments, the body portion 56 and stem portions 60 and 62 are formed as separate parts.

In some embodiments, the attachment 54 is not U-shaped, but instead shaped like a claw with prongs that grip the elevated track 40. In other embodiments, the sides of the attachment 54 envelop the elevated track such that each of stem portions 60 and 62 have lengths 66 that exceed a height 68 of the elevated track 40 but that are less than the height of the elevated track from the floor 44, thus avoiding contact with the floor 44.

Referring again to FIG. 3, the elevated track 40 is configured such that the attachment 54 can glide along a top 70 of the elevated track 40. The attachment 54 is a guide that allows movement of the shower door 24 in a controlled fashion. In some embodiments, a pair of attachments 54 are connected to each shower door 24. The attachment 54 is coupled to the shower door 24. As the shower door 24 moves along the elevated track 40, the attachment 54 moves in tandem with the door 24. In other words, the movement of the door 24 is controlled with respect to its speed and direction by the attachment 54. Further, in some embodiments, the attachment 54 acts to stabilize the door 24, providing additional structural support.

As shown in FIG. 3, the elevated track 40 is raised above the floor 44 by a height of the stands 80 and 82. The height of the stands may vary depending on the configuration of a shower door assembly in which the elevated track 40 is included. Such a configuration, for example, may depend on the dimensions of components in the assembly, the size of an enclosed shower area, sloping or surface features of the bathroom floor, and placement of plumbing features in a given bathroom. For example, a bathroom having a seven foot ceiling easily permits installation of shower doors that are sixty inches in height. In such a bathroom, a greater tolerance or variation can occur in positioning the elevated track 40 than would exist in bathrooms having a smaller difference between the shower door height and the ceiling.

Referring again to FIG. 3, the shower track guide system 200 is configured such that water flows beneath the elevated track 40. The shower track guide system thus permits water to flow without being accumulated in the elevated track 40. Water can drip off the sides of the attachment 54 and can run along the body portion 56 and the stem portions 60 and 62 of the attachment 54 before flowing towards a drain 88. As described above, the elevated track 40 is disposed above the floor 44 by a distance corresponding to the height of the stands 80 and 82 above which the elevated track 40 is positioned. In some embodiments, a single stand may be employed. In some embodiments, more than two stands may be positioned along a length of the elevated track 40. In some embodiments, stands such as the stands 80 and 82 shown in FIG. 3, are positioned at equal intervals along the length of the elevated track 40.

The stands 80 and 82 as shown in FIG. 3 serve to maintain a clearance between the elevated track 40 and the floor 44. The stands 80 and 82 are connected to the elevated track 40 such that the elevated track 40 is mounted above the stands 80 and 82. The stands 80 and 82 can include different materials, configurations, and shapes. For example, in one embodiment, stands 80 and 82 are each formed of bronze with a rustproof finish. In another embodiment, stands 80 and 82 are copper. In yet another embodiment, stands 80 and 82 are formed of a durable hard plastic sheathed in a moisture-resistant coating. Stands 80 and 82 can be painted to achieve desired aesthetic effects. Stands 80 and 82 need not be made of the same materials and do not need to have a common shape or configuration. In some embodiments, for example, in a bypass shower door system with two shower doors, the stands for each track may be common or shared between tracks.

In at least one embodiment, stands 80 and 82 have cubic shapes and form a dais or platform for the elevated track 40. Water flows between stands 80 and 82 and underneath the elevated track 40. In some embodiments, stands 80 and 82 may not be positioned at the same height. In some installations, for example, it may be advantageous to utilize a taller stand and a shorter stand. The use of a taller stand and a shorter stand may be advantageous, for instance, to counteract a height differential where a floor, such as the floor 44, is inclined. Positioning the taller stand at a lower end than the shorter stand can help to ensure a level placement of the elevated track 40.

Although this disclosure is not intended to limit the materials that may be used to make the attachment 54, according to an exemplary embodiment, the attachment 54 may be a hard silicone rubber. For example, a silicone rubber material may be injection molded to form the attachment 54. Further, a surface finish of attachment 54 may provide water dispersion aspects or act as a seal to prevent moisture from accumulating within the attachment 54. Attachment 54 may have a coating providing water resistance and added durability. In some embodiments, the attachment 54 in a shower track guide system may be made out of various materials, including a polymeric material, composite materials, metallic materials, and any combination of such materials. In at least one embodiment, the attachment 54 shower track guide system includes a resilient material that is plastic.

In some embodiments, the width 58 of the elevated track 40 is uniform. In other embodiments, the width 58 can vary along the length of the elevated track 40. The width 58 of the elevated track exceeds a width of the shower door 24. The elevated track 40 can, in some embodiments, form a so-called 'monorail' structure atop which an attachment, such as the attachment 54 shown in FIG. 3, or a roller, such as the roller 90 of FIG. 2, can ride. As shown in FIG. 2, no portion of the roller 90 is positioned lower than the elevated track 40. The elevated track 40 permits a slidable connection between the door 24 and the elevated track 40 without an attachment or roller being disposed within the elevated track 40. The rollers 90 slide or roll atop the track to alter the position of the door 24 relative to side walls 106 and 108 of the shower.

In some embodiments, the elevated track 40 is positioned relative to a bathtub rim (not shown) rather than a floor 44. A clearance exists between a base that is the bathtub rim or the floor 44 and the elevated track 40. The clearance is dictated by the height of the stands 80 and 82, as shown in FIG. 2, above which the elevated track 40 is positioned with respect to a bathtub rim.

Other configurations of the shower guide track system, including the attachment and/or the roller, are possible according to various other embodiments. Furthermore, it should be noted that the features of the shower track guide system may be used in combination with any of the other features of the shower track guide system disclosed herein.

In some embodiments, a method for directing water in a shower door system is provided. The method includes providing a track for a shower door, mounting the track to at least one stand, and elevating the track above a base by disposing the at least one stand between the base and the track. The method further includes connecting an attachment, such as the attachment 54, or a roller, such as the roller 90, to the track such that the attachment or the roller acts as a guide for controlling movement of a shower door, such as the inner shower door 24. The method further includes providing for the shower door to slide along the elevated track while permitting water to flow underneath the track. It will be appreciated that such a method inhibits water from accumulating in the track and instead directs water towards a drain of the shower.

One skilled in the art will readily appreciate the benefits of a shower track guide system. Advantageously, water can flow freely towards a drain of a shower so that the water and any dirt do not accumulate within the shower track system. Further, when it becomes desirable to clean a shower track guide system, a user may easily clean surfaces of the shower tracks because hard-to-reach recesses are not present.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower track guide system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to exemplary embodiments. Other substitutions, modifications, changes and omissions may also be made in the design, operating conditions and arrangement of the various exemplary embodiments without departing from the scope of the present disclosure.

What is claimed is:

1. A shower track guide system for a shower enclosure, the system comprising:

an elevated track positioned above a base;

at least one stand disposed between the base and the track, the track mounted above the at least one stand such that an upper surface of the at least one stand contacts a lowermost surface of the elevated track and a lower surface of the at least one stand contacts the base; and at least one guide coupled to a shower door of the shower enclosure, the at least one guide being configured to permit the shower door to move along a top of the track to permit access to the shower enclosure;

wherein the at least one stand elevates the track above the base to permit water to flow underneath the track, wherein the at least one guide is configured to travel along an uppermost surface of the elevated track in a direction of door movement, wherein no portion of the shower door is disposed lower than the uppermost surface of the elevated track, and wherein a movable connection is provided between the shower door and the elevated track without the at least one guide being disposed within the elevated track.

2. The shower track guide system of claim 1, wherein the at least one guide includes a body portion disposed on the track, the guide further including side portions that extend from opposing sides of the body portion towards the base.

3. The shower track guide system of claim 2, wherein the at least one guide is configured slide along the top of the track.

4. The shower track guide system of claim 2, wherein the side portions at least partially envelop the track.

5. The shower track guide system of claim 4, wherein a transverse section of the track is narrower than a width of the body portion of the guide.

6. The shower track guide system of claim 1, wherein the at least one guide comprises a bearing disposed on the track, the bearing being configured to support the shower door.

7. The shower track guide system of claim 1, wherein elevation of the track above the base prevents water from accumulating between the shower door and the track.

8. The shower track guide system of claim 1, wherein the at least one stand comprises at least two stands, wherein a height of a first stand of the at least two stands is different from a height of a second stand of the at least two stands.

9. The shower track guide system of claim 1, wherein the at least one stand maintains a clearance between the track and the base.

10. The shower track guide system of claim 1, wherein:

the uppermost surface of the elevated track is substantially planar; and the at least one guide encloses the uppermost surface of the track.

11. The shower track guide system of claim 1, wherein:

the at least one guide includes a body portion disposed on the track and side portions that extend from opposing sides of the body portion towards the base; and each of the side portions has a length that is less than a distance between the base and the lower surface of the elevated track.

12. A shower track guide system for a bypass shower door system including at least one shower door, the shower guide track system comprising:

a track along which the shower door is movable, wherein the track is elevated above a base by at least one stand coupled to the track to allow water to flow underneath the elevated track, the track being mounted above the at least one stand such that an upper surface of the at least one stand contacts a lowermost surface of the track and a lower surface of the at least one stand contacts the base; and at least one guide coupled to the shower door, the at least one guide configured to move along a top of the track; and wherein a clearance between the track and the base is maintained by the at least one stand coupled to the track, wherein the at least one guide is configured to travel along an uppermost surface of the elevated track in a direction of door movement, wherein no portion of the shower door is disposed lower than the uppermost surface of the elevated track, wherein a movable connection is provided between the shower door and the elevated track without the at least one guide being disposed within the elevated track, and wherein respective ends of the at least one stand are defined between the lowermost surface of the track and the base.

13. The shower track guide system of claim 12, wherein the at least one guide includes a body portion, the at least one guide further comprising side portions that extend from opposing sides of the body portion towards the base.

14. The shower track guide system of claim 12, wherein the at least one guide includes a bearing disposed on the track, the bearing being configured to support the shower door.

15. The shower track guide system of claim 12, wherein the track is mounted above the at least one stand, wherein the at least one stand is disposed between the track and the base.

16. A shower enclosure comprising:

an elevated track positioned above a base;

a shower door movable along a top of the track;

at least one stand coupled to the track and configured to provide a clearance between the track and the base, the track being mounted above the at least one stand such that an upper surface of the at least one stand contacts a lowermost surface of the track and a lower surface of the at least one stand contacts the base, and at least one guide coupled to the shower door, the at least one guide being configured to permit the shower door to move along a top of the elevated track to permit access to the shower enclosure, wherein a height of the clearance corresponds to an elevation of the track above the at least one stand to permit water to flow underneath the track, wherein the at least one guide is configured to travel along an uppermost surface of the elevated track in a direction of door movement, wherein no portion of the shower door is disposed lower than the uppermost surface of the elevated track, and wherein a movable connection is provided between the shower door and the elevated track without the at least one guide being disposed within the elevated track.

17. The shower enclosure of claim 16, wherein the at least one guide is configured as an attachment coupled to the shower door, wherein the attachment is configured to move in tandem with the door along the top of the track.

18. The shower enclosure of claim 17, wherein the attachment at least partially envelops the track.

* * * * *